US008512521B2

(12) United States Patent
Lackinger et al.

(10) Patent No.: US 8,512,521 B2
(45) Date of Patent: Aug. 20, 2013

(54) PRODUCT FOR THE SIZING OF PAPER

(75) Inventors: Elisabeth Lackinger, Vienna (AT); Klaus Möller, Krems (AT); Jürgen Sartori, Krems (AT); Leo Schmid, Glis (CH)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 13/263,121

(22) PCT Filed: Apr. 9, 2010

(86) PCT No.: PCT/FI2010/050288

§ 371 (c)(1), (2), (4) Date: Nov. 21, 2011

(87) PCT Pub. No.: WO2010/116044

PCT Pub. Date: Oct. 14, 2010

(65) Prior Publication Data

US 2012/0125553 A1 May 24, 2012

Related U.S. Application Data

(60) Provisional application No. 61/233,164, filed on Aug. 12, 2009.

(30) Foreign Application Priority Data

Apr. 9, 2009 (EP) ..... 09157679

(51) Int. Cl.
*D21H 21/16* (2006.01)
*D21H 17/16* (2006.01)

(52) U.S. Cl.
USPC ..... 162/179; 162/164.7

(58) Field of Classification Search
USPC ..... 162/158, 160, 164.7, 168.7, 172, 162/173, 179
See application file for complete search history.

(56) References Cited

U.S. PATENT DOCUMENTS

| | | | | | |
|---|---|---|---|---|---|
| 2,526,605 | A | * | 10/1950 | Fraser | 162/168.1 |
| 3,855,163 | A | | 12/1974 | Bussell | |
| 4,687,519 | A | * | 8/1987 | Trzasko et al. | 106/205.1 |
| 4,721,655 | A | | 1/1988 | Trzasko et al. | |
| 5,733,970 | A | * | 3/1998 | Craun | 524/811 |
| 2006/0236467 | A1 | | 10/2006 | Thames et al. | |
| 2009/0209441 | A1 | * | 8/2009 | Lange et al. | 508/239 |
| 2009/0283230 | A1 | * | 11/2009 | Lassus et al. | 162/164.1 |

FOREIGN PATENT DOCUMENTS

| | | | |
|---|---|---|---|
| CA | 1069410 | * | 1/1980 |
| CA | 1069410 | A1 | 1/1980 |
| CA | 1230558 | A | 12/1987 |

(Continued)

OTHER PUBLICATIONS

Thomas, A. Jun. 15, 2000. Fats and Fatty Oils. Ullmann's Encyclopedia of Industrial Chemistry.*

(Continued)

*Primary Examiner* — Eric Hug
(74) *Attorney, Agent, or Firm* — Thomas Horstemeyer

(57) ABSTRACT

The present invention relates to a paper sizing agent and emulsion comprising a maleated vegetable oil size wherein at least 50% by weight of the total fatty acids of the triglycerides are monounsaturated. The invention also relates to a process for the preparation of such maleated vegetable oil size.

35 Claims, 3 Drawing Sheets

(56) References Cited

FOREIGN PATENT DOCUMENTS

| | | | |
|---|---|---|---|
| CN | 1977081 | A | 6/2007 |
| DE | 19835330 | A1 | 8/1998 |
| FR | 2396120 | A | 1/1979 |
| WO | 03000992 | A2 | 1/2003 |
| WO | 03057983 | A | 7/2003 |
| WO | 03057983 | A1 | 7/2003 |
| WO | 2005071050 | A | 8/2005 |
| WO | 2005077996 | A | 8/2005 |
| WO | 2006002867 | A | 1/2006 |
| WO | 2006002867 | A1 | 1/2006 |
| WO | 2007070912 | A1 | 6/2007 |

OTHER PUBLICATIONS

The International Search Report and Written Opinion dated Jun. 15, 2010.

The European Search Report dated Sep. 24, 2009.

Office Action cited in China in Chinese patent application No. 201080015617.0, Jan. 29, 2013.

* cited by examiner

PRODUCT FOR THE SIZING OF PAPER

CROSS REFERENCE TO RELATED APPLICATION

This application claims priority to PCT Application entitled "Produce for the Sizing of Paper," having serial number PCT/FI2010/050288, filed on 9 Apr. 2010, which claims priority to and benefit of European Patent Application No. 09157679.3, filed on Apr. 9, 2009 and U.S. Provisional Application No. 61/233,164, filing date Aug. 12, 2009, both of which are incorporated by reference in their entirety.

FIELD OF THE INVENTION

The present invention relates to a paper sizing emulsion comprising a maleated vegetable oil size, and to a process for the preparation of such maleated vegetable oil size.

BACKGROUND OF THE INVENTION

To be able to produce paper of a certain quality different chemical additives may be used during the production process. Generally, it is distinguished between process chemicals used to enhance the runnability of the process, and functional chemicals which provide certain properties to the finished paper.

Sizing of paper is used to hinder penetration of water into the sheet. This repellence is needed for durability and other wished paper characteristics like printability. Thus, sizing agents belong to the functional chemical group. Hydrophobation of the fiber can be achieved by a modification of the fiber constitution in the paper. Molecules which are able to attach to the fiber with one side and hinder the penetration of water with the other side are added to the furnish during the papermaking process. When paper is sized in this way it is called internal sizing.

Another way of sizing is to apply the sizing agent only on the surface of already finished paper-sheets. Therefore the paper is coated with a film consisting of a sizing agent, polymer solution and additives. This is called surface sizing.

Due to the increasing use of calcium carbonate as filler modern paper machines are run at a neutral or slightly alkaline pH. This limits the application of rosin or rosin soaps, which are classical sizing agents under acidic conditions.

As it is believed that the common sizing agents for neutral and alkaline sizing react with the hydroxyl groups of the cellulose, they are also called reactive sizes. The most common used reactive sizes are alkyl ketene dimers (AKD) and alkenyl succinic anhydrides (ASA). While the first mentioned shows a reasonable hydrolytic stability the opposite is true for ASA. Consumption of reactive sizing agents is significantly lower than for the rosin sizes.

For ASA-production α-olefins need to be isomerized to form internal olefins. This means the double bond is shifted away from an outward position of the molecule. In a second step the olefine reacts with maleic acid anhydride (MAA) at high temperature. The prior production of the internal olefin is necessary due to the higher melting point of an ASA produced from α-olefin, which means the α-ASA would be solid at room temperature and this would make the application at paper machines quite difficult.

An interest to substitute petrochemical based raw materials with renewable resources is recently observable not only in the paper industry. So a new sizing agent based on green sources can possibly be used to gain market potential. The production of ASA is dependent on petrochemicals (olefin) and therefore its production cost is strongly influenced by the heavily fluctuating price for crude oil.

WO 03/000992 discloses a soybean derived product (PDS size) comprising pure fatty acids extracted directly from soybean oil.

WO 2007/070912 discloses the use of liquid fatty acid anhydrides (FAA) derived from mixtures of saturated and unsaturated fatty acid mixtures with a chain length of $C_{12}$-$C_{24}$. The fatty acid anhydride consists of two fatty acids, of a fatty acid and acetic acid, of a fatty acid and a rosin acid, or a mixture thereof. The fatty acid may be derived from tall oil, sunflower oil, rapeseed oil, soy bean oil, linseed oil or animal oil.

WO 2006/002867 disclose yet another alternative sizing agent in the form of a dispersion comprising dispersed in water a sizing agent composed of a reaction product of maleic acid anhydride (MAA) and an unsaturated fatty acid alkyl ester, the sizing dispersion additionally comprising an aluminium compound such as aluminium sulphate, polyaluminium sulphate or polyaluminium chloride.

CA 1 069 410 discloses the use of an emulsifying agent comprising a trialkylamine or ammonium hydroxide in combination with a sizing agent. The sizing agent may be a maleated vegetable oil, maleated α-olefine, maleated fatty ester or AKD.

Maleated oils are well known in the literature for various purposes. According to U.S. Pat. No. 3,855,163 the modified oils are used as additives for electro deposition, while CA 1 230 558 and DE 198 35 330 suggest adding the same to hair care products. According to WO 2005/077996 and WO 2005/071050 maleated vegetable oils are used as emulsifiers. Additionally, US 2006/0236467 teaches that maleated oils are useful in forming latexes, coatings and textile finishes.

SUMMARY OF THE INVENTION

There is a clear demand for alternative sizing agents which use renewable resources, and result in a good sizing result. The present invention provides such a sizing agent which is based on a maleated vegetable oil having a specific composition. The sizing agent is used as emulsion and it is suitable for internal sizing and surface sizing.

DETAILED DESCRIPTION OF THE INVENTION

Figure 1:
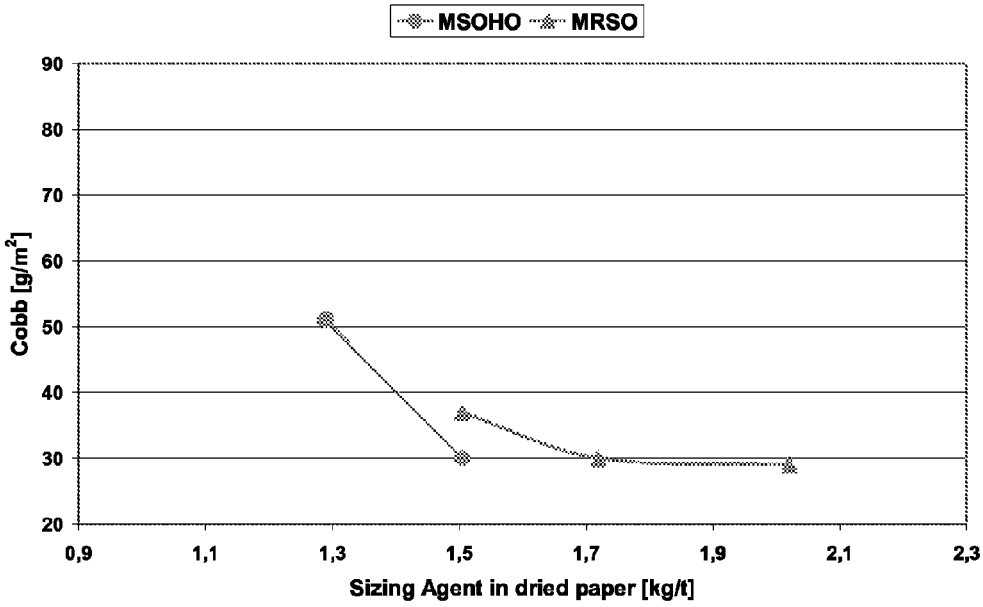
FIG. 1 shows the sizing efficiency of maleated high oleic sunflower oil size (MSOHO) and maleated rapeseed oil size (MRSO)

According to one aspect of the present invention there is provided a paper sizing agent comprising, as the first component, a maleated vegetable oil wherein at least 50% by weight of the total fatty acids of the triglycerides are monounsaturated, and, as the second component, an alkenyl succinic anhydride (ASA) and/or a fatty acid anhydride (FAA).

By the term "size" or "sizing agent" is meant an active compound or a mixture of active compounds suitable for use in sizing paper.

The vegetable oil size of the present invention is emulsified in an aqueous solution. Thereby a paper sizing emulsion which is an aqueous emulsion, is formed.

According to a further aspect of the present invention there is provided a paper sizing emulsion comprising a maleated vegetable oil size wherein at least 50% by weight of the total fatty acids of the triglycerides are monounsaturated.

The main constituent of a vegetable oil is triglyceride in which glycerol is esterified with three fatty acids.

Preferably at least 60% by weight, more preferably at least 70% by weight, and most preferably at least 80% by weight of the total fatty acids of the triglycerides are monounsaturated.

According to the present invention the vegetable oil of the maleated vegetable oil preferably originates from vegetable oil comprising rapeseed oil (including Canola oil), high oleic sunflower oil, high oleic safflower oil, olive oil or hazelnut oil or a mixture thereof. High oleic sunflower oil is especially preferred.

Typical oleic acid contents of some suitable vegetable oils are as follows.

High oleic sunflower oil 70-85%, rapeseed oil 51-67%, olive oil 58-83% and hazelnut oil 77-84%.

The paper sizing emulsion according to the present invention may additionally comprise a second size comprising an alkenyl succinic anhydride (ASA) size or a fatty acid anhydride (FAA) size or a mixture thereof.

The FAA size in the paper sizing agent and in the paper sizing emulsion preferably consists of two fatty acids, of a fatty acid and acetic acid, of a fatty acid and a rosin acid, or a mixture thereof.

The fatty acid of the FAA size is preferably derived from tall oil, sunflower oil, rapeseed oil, soy bean oil, linseed oil or animal oil or a mixture of two or more of these oils.

In the embodiments wherein the paper sizing emulsion comprises a second size the weight ratio of the maleated vegetable oil size to the second size is preferably from 1:9 to 9:1, more preferably from 3:7 to 7:3.

In one preferred embodiment of the paper sizing agent the weight ratio of the first component of the maleated vegetable oil to the second component of the alkenyl succinic anhydride (ASA) and/or the fatty acid anhydride (FAA) is from 1:9 to 9:1, preferably from 3:7 to 7:3.

In a further preferred embodiment the amount of the maleated vegetable oil together with FAA is from 10% to 90% by weight of the paper sizing agent. Preferably, this amount is from 30% to 50% by weight.

A synergistic effect was found when the influence of ASA, maleated vegetable oil, preferably MSOHO (maleated high oleic sunflower oil), and a mixture of maleated vegetable oil and FAA on sizing was studied. One drawback in using MSOHO is its high viscosity. Increasing the viscosity of the sizing agent increases the $Cobb_{60}$ value (DIN 53 132). On the other hand, FAA has a very low viscosity but is a weaker sizing agent. In the present invention it is found that small amounts of added FAA help cutting the viscosities of the blends considerably without sacrificing the sizing effect of the blend. Furthermore, the sizing effect of the blend of the maleated vegetable oil and FAA may even be better than the sizing effect of each of these components as such.

In a preferred embodiment of the paper sizing agent the weight ratio of the first component, the maleated vegetable oil wherein at least 50% by weight of the total fatty acids of the triglycerides are monounsaturated, to the second component of the fatty acid anhydride (FAA) is from 9.5:0.5 to 6.5:3.5 preferably from 9:1 to 7:3.

In a yet further preferred embodiment the paper sizing agent comprises a maleated vegetable oil wherein at least 50% by weight of the total fatty acids of the triglycerides are monounsaturated, a fatty acid anhydride (FAA), an antioxidant such as vitamin E or a phenolic compound, preferably di-tert-butyl hydroxytoluene (BHT) or tert-butyl hydroxyanisole (BHA) or a mixture thereof and an anionic or non-ionic emulsifier, preferably a sulfosuccinate, such as sodium salt of di-octyl sulfosuccinate (Na-DOSS), or a fatty alcohol ethoxylate, such as tridecyl-alcohol ethoxylate, and optionally an alkenyl succinic anhydride (ASA). The amount of the emulsifier is preferably from 0.5 to 2% by active weight of the sizing agent(s). Preferably, this sizing agent is essentially nonaqueous.

In a further embodiment of the paper sizing emulsion the second size comprises a mixture of the alkenyl succinic anhydride (ASA) size and the fatty acid anhydride (FAA) size.

The paper sizing emulsion according to the present invention may additionally comprise an anionic or non-ionic emulsifier, such as a sulfosuccinate, e.g. sodium salt of di-octyl sulfosuccinate (Na-DOSS), or a fatty alcohol ethoxylate, e.g. tridecyl-alcohol ethoxylate. The amount of the emulsifier is preferably from 0.5 to 2% by active weight of the sizing agent(s). The paper sizing emulsion according to the present invention may additionally comprise a protective colloid such as polymer, starch, or another polysaccharide. Starch can be modified starch for example cationic starch. It may further be anionic or amphoteric starch.

The paper sizing emulsion according to the present invention may additionally comprise an aluminium salt such as aluminium sulphate or polyaluminium chloride. However, more preferably the aluminium salt such as aluminium sulphate or polyaluminium chloride is added separately to the fiber stock after the addition of the paper sizing emulsion.

The formation of the maleated vegetable oils of the present invention is shown in following reaction scheme wherein one mole of a triglyceride having $C_{18:1}$ chains is reacted with one mole of maleic acid anhydride.

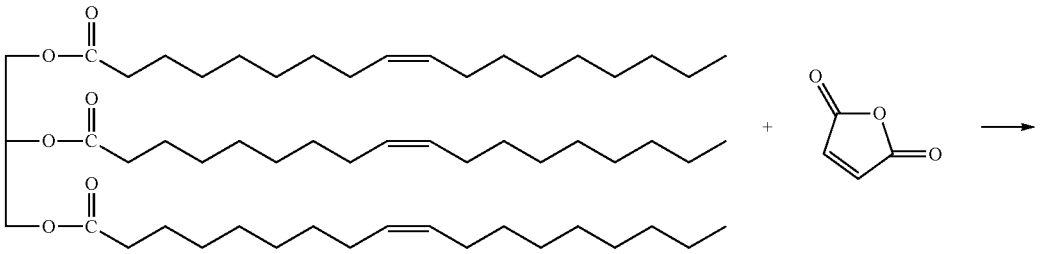

-continued

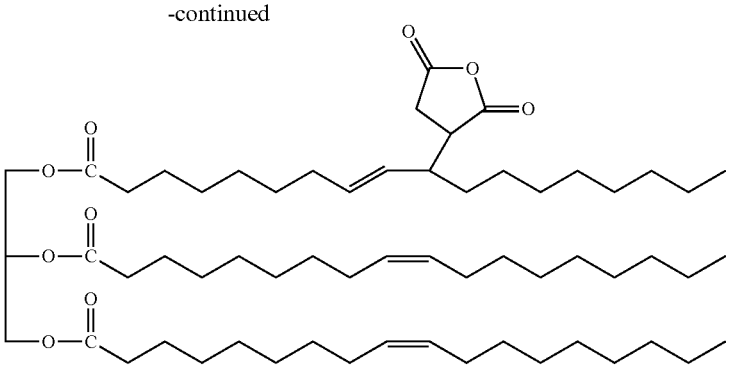

According to the invention the molar ratio of maleic acid anhydride to triglyceride in the maleated vegetable oil is preferably at least 0.8:1, more preferably at least 1:1, and most preferably at least 1.2:1. The molar ratio of maleic acid anhydride to triglyceride in the maleated vegetable oil is at most 2:1, preferably at most 1.8:1, more preferably at most 1.6:1.

The maleated vegetable oil is obtained by reacting maleic acid anhydride with the vegetable oil in a molar ratio of maleic acid anhydride to the triglyceride of preferably at least 1:1, more preferably at least 2:1, and most preferably at least 3:1. With higher ratios the reaction time is shortened and the content of residual oil decreases. One benefit of the shorter reaction time is that fewer polymers are produced as the time the reaction mixture is held at high temperature is reduced. The reaction temperature is typically 190-250° C. and the reaction time typically 2-8½ h, preferably 3½-8½ h, and more preferably 5-7 h. Too long reaction times lead to the increase of the viscosity of the product. The excess MAA is distilled off after reaction typically at a temperature 120-140° C. and in reduced pressure for example at 10 mbar for 1 hour. MAA can be added in one or several portions.

It is preferred to carry out the reaction between vegetable oil and MAA in an inert atmosphere such as nitrogen or argon atmosphere which also suppresses the formation of unwanted polymer material.

The reaction between MAA and the vegetable oil is preferably carried out in the presence of an antioxidant such as vitamin E or a phenolic compound, preferably di-tert-butyl hydroxytoluene (BHT) or tert-butyl hydroxyanisole (BHA) or a mixture thereof. Typical amount of antioxidant or their mixture is about 0.02% vitamin E, BHT, BHA. Typical mixture is a 1:1 mixture of BHT and BHA. The antioxidant inhibits the formation of unwanted by-products, especially polymeric by-products. The formed polymeric material has a negative effect on the sizing performance and additionally causes runnability problems in the production process. Additional drawbacks of the polymeric material are a dark colour and an increase in the viscosity of the size. Other useful antioxidants are benzoquinone derivates, hydroquinone derivates, dialkylsulfoxide, acetylacetonate of a transition metal or acetylacetonate of a transition metal oxide. Additionally, boric acid or mixtures of boric acid and BHT can be used.

In a preferred embodiment the paper sizing agent is prepared by mixing maleated vegetable oil wherein at least 50% by weight of the total fatty acids of the triglycerides are monounsaturated with an alkenyl succinic anhydride (ASA) and/or a fatty acid anhydride (FAA). The maleated vegetable oil is prepared by the above described reaction preferably in an inert atmosphere, at a temperature from 190° C. to 250° C. and in a reaction time from 2 h to 8.5 h, more preferably 3.5-8.5 h, and most preferably 5-7 h, and in an elevated pressure, preferably from 1 bar to 5 bar, more preferably from 2.5 bar to 4.5 bar, The excess maleic acid anhydride is preferably distilled off after the reaction. Yet preferably, the maleated vegetable oil is produced by reacting maleic acid anhydride with the vegetable oil in the presence of an antioxidant such as vitamin E or a phenolic compound, preferably di-tert-butyl hydroxytoluene or tert-butyl hydroxyanisole or a mixture thereof.

According to the present invention there is additionally provided a process for the preparation of a paper sizing emulsion comprising emulsifying a maleated vegetable oil size wherein at least 50% by weight of the total fatty acids of the triglyceride are monounsaturated in an aqueous phase by means of an emulsifier, and optionally a protective colloid, and/or by means of vigorous mixing. The paper sizing emulsion and the components thereof are as defined above.

The concentration of the size(s) in the aqueous emulsion is preferable between 10% and 0.1%, more preferably between 5% and 0.5%. Prior to the addition of the sizing emulsion, and optionally the protective colloid, of the invention into the fibre stock the emulsion can be diluted for example in the proportion 1 part of emulsion to 10 parts of water. Preferably the emulsifier is dissolved in the size prior to the emulsification. Additional agents conventionally used in paper manufacturing including aluminium salts such as aluminium sulphate or polyaluminium chloride and retention aids such as a cationic polymer may be added to the fibre stock.

In one embodiment the emulsion comprises from 0.1 weight-% to 10 weight-% of sizing agent, preferably from 0.5 weight-% to 5 weight-%.

For the preparation of the sizing emulsion with the maleated vegetable oil the same standard devices that are common with ASA can be used. Emulsifiers are not necessary for these processes, but their addition leads to smaller particles and therefore is beneficial. An especially preferred emulsifier is sodium di-octyl sulfosuccinate, because of its stability in cold maleated vegetable oils.

According to the present invention it is possible to emulsify the maleated vegetable oil size on-site at the paper mill. This can be done without or with emulsifiers in the same way and with the same high shear devices as for ASA size.

The present invention also relates to the use of a paper sizing emulsion as defined above or prepared by the above process, for surface sizing or internal sizing of papers, such as various printing papers, magazine papers, newsprint papers and copy papers, and boards, such as packing boards and liquid packing boards. Typical amount of size for papers, especially printing paper, and for boards is about 0.2-3 kg/t, preferably about 0.4-2.5 kg/t (active content/paper ton).

By the used term maleic acid anhydride (MAA) is also meant maleic anhydride.

All percentages are expressed as weight-% unless otherwise stated.

EXAMPLE 1

73.7 kg rapeseed oil (oleic acid content 53.9%) was reacted with 16.3 kg maleic acid anhydride (MAA) with the addition of 0.0122% of the antioxidant Anox 330 (1,3,5-trimethyl-2,4,6-tris(3,5-di-tert-4-hydroxybenzyl)benzene) under nitrogen atmosphere at ~215° C. MAA:triglyceride was 2:1. MAA was added in 16 portions. The first 8 portions of 407.5 g MAA were added every 15 minutes, while the last 8 portions of 1.63 kg were added every 30 minutes. After additional 2.5 h reaction time the reactor was cooled down, residual MAA was distilled off after production and 1.0 weight-% of Na-dioctylsulfosuccinate (Na-DOSS) was added to the MRSO product. R was 1.11 (R means the molar ratio of MAA to triglyceride in the maleated product). The whole reaction time was about 8 hours.

EXAMPLE 2

73.7 kg high oleic sunflower oil (oleic acid content 79.5%) was reacted with 16.3 kg maleic acid anhydride (MAA) with the addition of 0.0122% Anox 330 under nitrogen atmosphere at ~215° C. MAA:triglyceride was 2:1. MAA was added in 16 portions. The first 8 portions of 407.5 g MAA were added every 15 minutes, while the last 8 portions of 1.63 kg were added every 30 minutes. After additional 2.5 h reaction time the reactor was cooled down, residual MAA was distilled off after production and 1.0 weight-% Na-DOSS was added to the MSOHO product. R was 1.05. The whole reaction time was about 8 hours.

EXAMPLE 3

Sized papers were tested by making Cobb tests; sheets of paper with the use of the new sizing agents from Example 1 or 2 were produced. Sheets were formed on a Rapid-Koethen sheet former with grounded cellulose (30° SR, 2% dry content, 30% short fibre and 70% long fibre from bleached kraft pulp). In a first step 1% of the tested sizing agent was emulsified in a polymer solution (4% HI-CAT 5103A cationic starch in water)—with an Ultra Turrax for 2 minutes at 10 000 rpm at 70° C. This emulsion was diluted 1:10 with deionized water and 3-4.7 ml (≈1.3-2.0 kg/t) of this dilution was added to approx. 190 g respectively 240 g paper stock (diluted from 2% stock solution, containing 1% fibers and 0.25% grounded calcium carbonate (GCC) at room temperature. Afterwards following chemicals were added to the slurry to help in sizing: 1 ml Alum (1%) and 4.6 ml Fennopol (0.01%, cationic polymer, K 3400R from Kemira Oyj). Then the sheet was formed at room temperature. The freshly prepared sheet was dried in a drum dryer at ~115° C. for 40 s, and at 125° C. for 10 min in an oven. Subsequently, the water uptake in 60 seconds was determined according to the Cobb test, German Industrial Standard DIN 53132. The results are presented in FIG. 1.

EXAMPLE 4

73.7 kg high oleic sunflower oil (oleic acid content 81.2%) was reacted with 16.3 kg maleic acid anhydride (MAA) with the addition of 18 g (0.02%) of the antioxidant BHT (di-tert-butyl hydroxytoluene) under nitrogen atmosphere (p: 1.3-1.5 bar) at ~215° C. MAA:triglyceride was 2:1. MAA was added in 1 portion. The reaction time was about 7½ hours. Residual MAA was distilled off after production. Finally 1.0 weight-% Na-DOSS was added. R was 1.26. Following blends with ASA (Hydrores AS 2100, which contained the same amount of emulsifier) were made: 25 w-%, 30 w-% and 50 w-% MSOHO in ASA.

EXAMPLE 5

Figure 2:
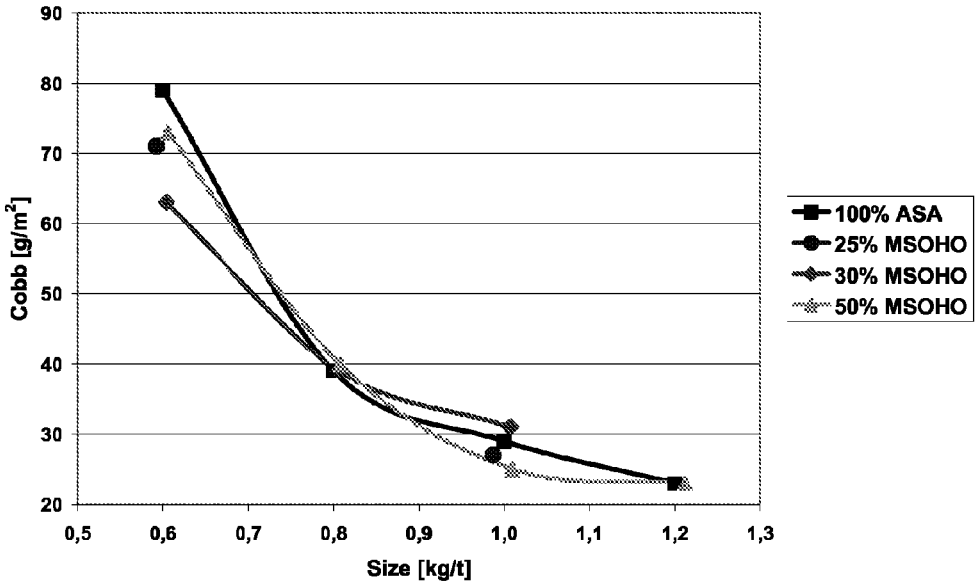
FIG. 2 shows the sizing efficiency of blends with different amounts of MSOHO and ASA.

1 g size according to example 4 was emulsified in 99 g starch solution (4% High Cat 5103A) at 70° C., 10 000 rpm, for 2 min. This emulsion was diluted 1:10, 1.5-3 ml (≈0.6-1.2 kg size/t of paper) of it was added to approx. 190 g of the paper stock (containing 1% fibers and 0.25% GCC) at 45° C., 1.5 ml Alum (1%) and 4.6 ml Fennopol K3400 R (0.01%) were added after the size emulsion. Then the sheet was prepared and dried in a drum dryer once. From the measured Cobb values presented in FIG. 2 can be seen that the blends have a sizing efficiency as good as ASA alone.

EXAMPLE 6

Figure 3:
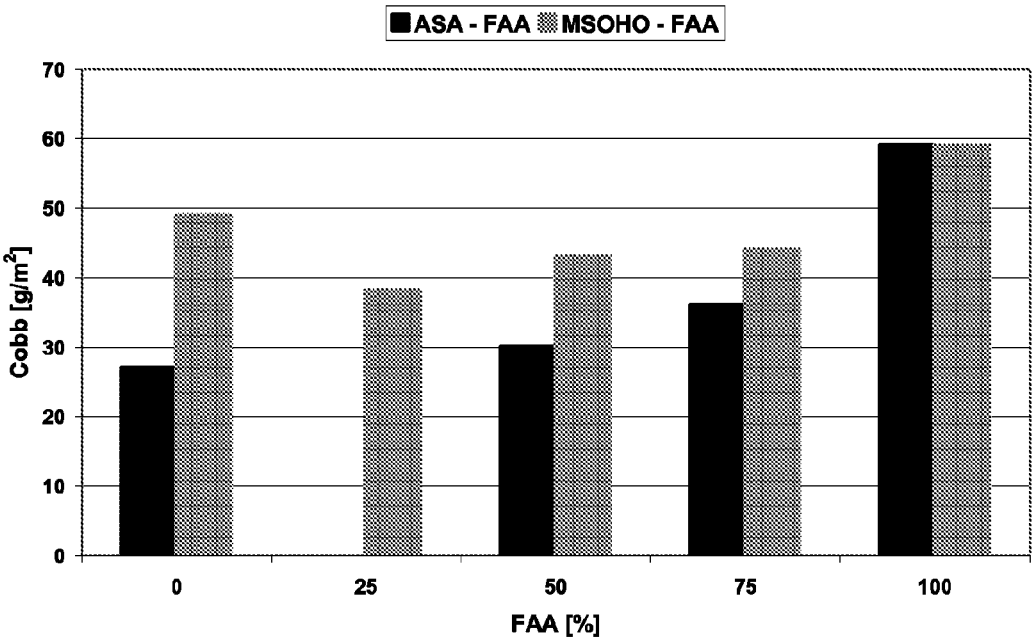
FIG. 3 shows the sizing efficiency of blends of ASA and MSOHO with FAA.

Part of the MSOHO product of example 2 containing 1.0% Na-DOSS was blended with FAA (Sacacid FAA 1000). For comparison, blends were made also mixing ASA (Hydrores AS 1000) with FAA (Sacacid FAA 1000). The following compositions were made: FAA-ASA: 0% FAA, 50% FAA, 75% FAA, 100% FAA, FAA-MSOHO: 0% FAA, 25% FAA, 50% FAA, 75% FAA, 100% FAA. 1 g of each blend was emulsified in 99 g starch solution (4% HiCat 5103A) at 70° C., 10 000 rpm, for 2 min. Emulsions were diluted 1:10 and 2.5 ml (≈1.1 kg/t) was added to approx. 165 g paper stock (containing 1% fibers and 0.25% GCC) at room temperature, 1.7 ml Alum (1%) and 4.6 ml Fennopol K3400 R (0.01%) were added. Then the sheets were prepared and dried in a drum dryer once and for 10 min at 125° C. in an oven. From the measured Cobb values presented in FIG. 3 can be seen that blends of FAA and SOHO have better sizing efficiency than both pure sizing agents. It clearly proves the synergy between FAA and SOHO, which cannot be seen in the ASA-FAA blends.

EXAMPLE 7

Figure 4:
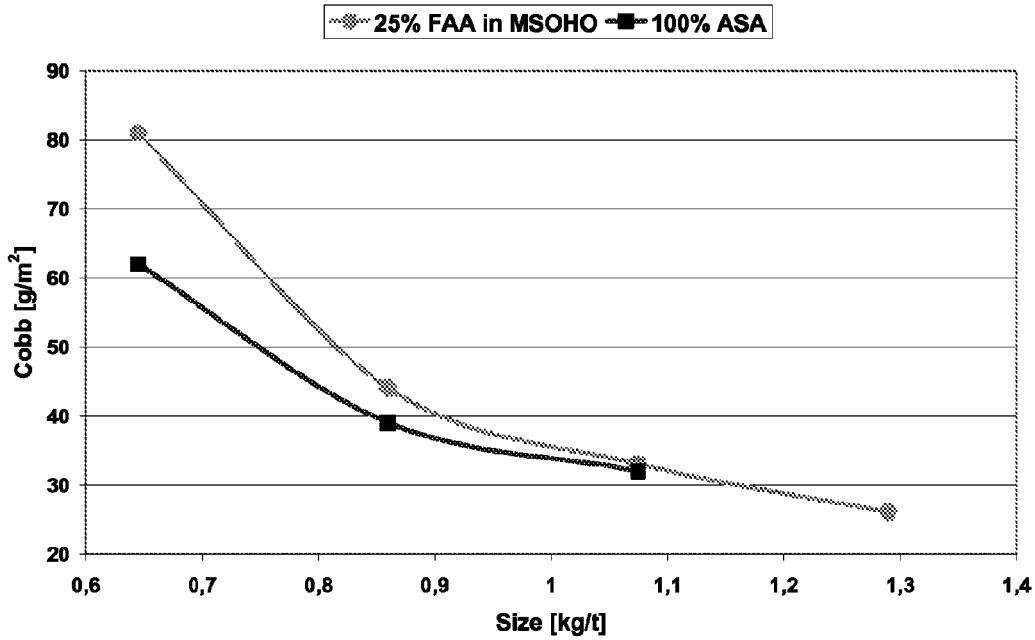
FIG. 4 shows the sizing efficiency of blends of MSOHO with 25% FAA.

Part of the MSOHO product of example 2 containing 1.0% Na-DOSS was blended with 25% FAA (Sacacid FAA 1000). The efficiency of that blend was compared to 100% ASA (Hydrores AS 1000). 1 g of each blend was emulsified in 99 g starch solution (4% HiCat 5103A) at 70° C., 10 000 rpm, for 2 min. This emulsion was diluted 1:10 and 1.5-3 ml (≈0.6-1.3 kg/t) was added to approx. 186 g paper stock (containing 1% fibers and 0.25% GCC) at 45° C. 1.5 ml Alum (1%) and 4.6 ml Fennopol K3400 R (0.01%) were added. Then the sheet was prepared and dried in a drum dryer once. From the measured Cobb values presented in FIG. 4 can be seen that there is only a small difference between the pure ASA and the MSOHO-FAA blend.

EXAMPLE 8

Figure 5:
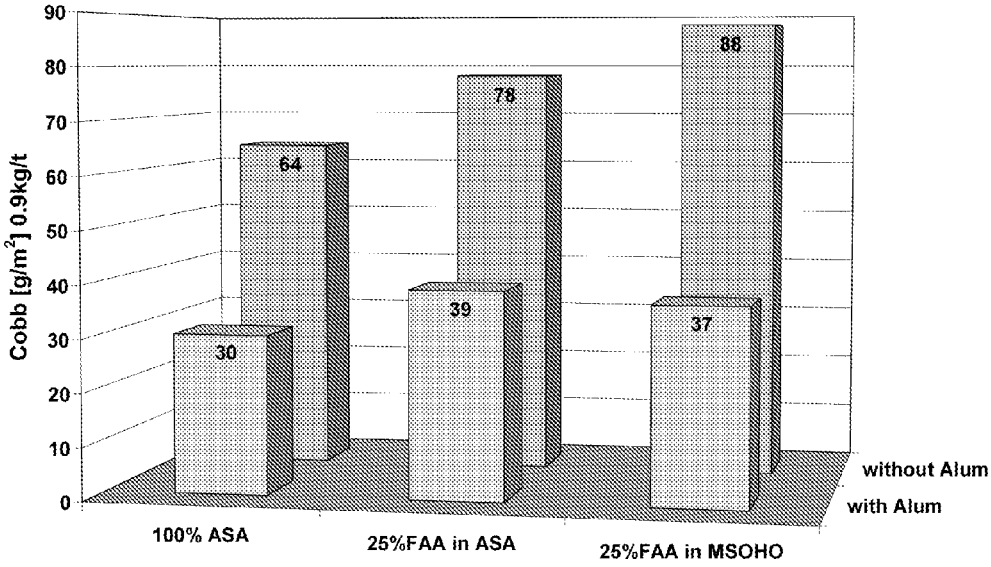
FIG. 5 shows the sizing efficiency of blends of MSOHO with 25% FAA with and without alum compared with pure ASA.

Part of the MSOHO product of example 2 containing 1.0% Na-DOSS was blended with 25% FAA (Sacacid FAA 1000). The efficiency of that blend was compared to a blend containing 25% FAA in ASA and to 100% ASA (Hydrores AS 1000). Comparison was made with and without 1.5 ml Alum (1%). 1 g of each blend was emulsified in 99 g starch solution (4% HiCat 5103A) at 70° C., 10 000 rpm, for 2 min. This emulsion was diluted 1:10 and 2 ml (≈0.9 kg/t) was added to approx. 186 g of the paper stock (containing 1% fibers and 0.25% GCC) at 45° C. 1.5 ml Alum was added to part of the sheets and 4.6 ml Fennopol K3400 R (0.01%) was added to each sheet. Then the sheets were prepared and dried in a drum dryer once. From the measured Cobb values presented in FIG. 5 can be seen that the addition of alum has a big influence on the sizing efficiency and FAA blends with MSOHO has the same sizing efficiency as FAA blends with ASA.

EXAMPLE 9

885.5 g (~1 mol) vegetable oil (rapeseed oil or high oleic sunflower oil) was put into the reactor and flashed with nitrogen. Then the oil was heated to ~215° C. under stirring and 8×4.9 g (=0.05 mol) MAA were added every 15 minutes, afterwards 8×19.6 g (=0.2 mol) MAA was added every 30 minutes. After 1.5 hours the reaction product was allowed to cool down. In a last step the residual MAA was distilled at a vacuum at p<10 mbar at 120-140° C.

This recipe (MAA:Triglyceride=2:1) was altered using different ratios of MAA per triglyceride (e.g. 1:1-4:1).

The ratio MAA per Triglyceride (R) in the maleated vegetable oil size after reaction and distillation of excess MAA was calculated with the following formula:

$$R = \frac{MW_{(Oil)}}{\left(\frac{2000 * MW_{(KOH)}}{(SN_{(Product} - SN_{(Oil)}} - MW_{(MAA)}\right)} \quad (2)$$

$MW_{(Oil)}$=885.5 g/mol with the assumption, that it only consists of glycerol-trioleat, $MW_{(KOH)}$=56.1 g/mol and $MW_{(MAA)}$=98.1 g/mol and SN=saponification number The ratios are presented in table 1.

TABLE 1

| Oil | MAA:Oil molar ratio in synthesis | R |
|---|---|---|
| Rapeseed oil | 2:1 | 1.2 |
| Rapeseed oil | 3:1 | 1.5 |
| Rapeseed oil | 4:1 | 1.7 |
| High oleic sunflower oil | 3:1 | 1.2 |
| High oleic sunflower oil | 4:1 | 1.3 |

EXAMPLE 10

73.7 kg high oleic sunflower oil was reacted with 16.3 kg maleic acid anhydride (MAA) with the addition of 18 g BHT (0.02 weight-%, antioxidant) under nitrogen atmosphere (p: 1.3-1.5 bar) at ~215° C. MAA was added in 1 portion. The reaction time was ~7.5 hours. Residual MAA was distilled off after production. Finally 1.0 weight-% Na-DOSS was added to the MSOHO.

EXAMPLE 11

In the Paper Mill the same high shear device that is conventionally used for the on-site emulsification of ASA was used for emulsifying the maleated vegetable oil blends as well. Here the starch had a temperature of about 70° C.

In Mill Trials blends with 30% maleated vegetable oils (rape seed oil or high oleic sunflower oil) and 70% ASA (Hydrores AS 2100) were emulsified properly with the existing devices. This was proved by measuring the particle size distribution of the produced emulsions using laser (-light) scattering particle size distribution analyzer Horiba L A-300 (Horiba Ltd., Kyoto, Japan).

Following blends were made:

30% maleated vegetable oil sizes according the examples 1 or 2 were blended with 70% ASA (Hydrores AS 2100) and used during a trial in mill 1. The particle sizes after emulsification with the on-site equipment of the mill in comparison to the standard ASA size (Hydrores AS 2100) are given in Table 2.

30% maleated vegetable oil size according example 10 was blended with 70% ASA (Hydrores AS 2100) and used during a trial in mill 2. The particle sizes after emulsification with the on-site equipment of the mill in comparison to the standard ASA size (Hydrores AS 2100) are given in Table 3.

From the results presented in Table 2 and 3 no significant difference can be seen between pure ASA and the ASA-maleated oil blends.

TABLE 2

| | D50 [μm] |
|---|---|
| ASA | 1.16 |
| ASA MSOHO blend | 1.10 |
| ASA MRSO blend | 1.27 |

TABLE 3

| | D50 [μm] | D90 [μm] |
|---|---|---|
| ASA | 0.82 | 2.07 |
| ASA + 30% MSOHO | 0.82 | 1.93 |

EXAMPLE 12

150 g high oleic sunflower oil (oleic acid content 81.2%) was put into the reactor and flashed with argon. Then the oil was heated to 215° C. under stirring, 33.2 g MAA were added, and the pressure was adjusted to ~3.3 bar. MAA:triglyceride was 2:1. The temperature was held for 8 hours. In a last step the residual MAA was distilled at a vacuum of p<10 mbar at 120-140° C. Different antioxidants were added to the oil before filling it into the reactor to prevent the production of unwanted by-products. The polymer contents of reaction products which were made with different antioxidants was analyzed with GPC.

In Table 4 the results of these analyses are presented. One can see that the use of antioxidant in the synthesis decreases the amount of unwanted polymeric by-products in the maleated vegetable oil. Furthermore it was shown, that a10 fold increase in the BHT concentration did not improve the results concerning the polymer concentration, and thus it is sufficient to use 0.02% antioxidant.

TABLE 4

| Trial | Polymers [%] |
|---|---|
| without | 15.2 |
| 0.02% Vitamin E | 13.0 |
| 0.2% BHT | 13.6 |
| 0.02% BHT | 12.9 |
| 0.01% BHT + 0.01% BHA | 10.3 |

EXAMPLE 13

Maleated high oleic sunflower oil (MSOHO) was produced according example 12 with the exception that the ratio of MAA:Triglyceride was altered from 2:1-4:1 (33.2 g-66.4 g) but antioxidant was kept constant. The used high oleic sunflower oil had a content of 81.2% oleic acid. 0.02% BHT was added to the high oleic sunflower oil before filling it into the reactor. As the reaction accelerates with higher ratios of MAA per triglyceride, the time for the reactions was adjusted. The calculated R varied from 1.12 for 2:1 to 1.41 for 4:1.

Polymer content was measured with GPC and residual oil content with HPLC at the given times; the results are presented in table 5.

TABLE 5

| Molar ratio | Reaction time [min] | Polymers [%] | Residual oil [%] |
|---|---|---|---|
| 2:1 | 480 | 12.6 | 15.5 |
| 3:1 | 300 | 6.0 | 13.3 |
| 4:1 | 200 | 5.9 | 5.7 |

EXAMPLE 14

130 g high oleic sunflower oil (oleic acid content 81.2%) with 19 mg BHT (0.01 weight-%) and 19 mg BHA (0.01 weight-%) were put into the reactor and flashed with argon. Then the oil was heated to 200° C. under stirring, 57.8 g MAA were added, and the pressure was adjusted to ~3.3 bar. MAA: triglyceride was 4:1. The temperature was held for 5-6.5 hours. In a last step the residual MAA was distilled at a vacuum at p<10 mbar at 120-140° C. for 40-60 minutes.

EXAMPLE 15

The reaction according to example 14 was made by altering the reaction time. Viscosity, polymer content, residual oil, and MAA:triglyceride ratio (R) in the maleated vegetable oil were measured after reaction and distillation.

R was calculated using the saponification number method. The viscosity was measured with a rotational-viscometer (Anton Paar GmbH, Austria, RHEOLAB MC1) at 20° C. and a shear rate of 50 s-1 from the table 6 can be seen that viscosity increases with the increasing reaction time.

TABLE 6

| Time [min] | R | Viscosity [mPas] | Polymers [%] | Residual oil [%] |
|---|---|---|---|---|
| 360 | 1.22 | 2751 | 4.3 | 13.0 |
| 400 | 1.36 | 4055 | 7.5 | 8.8 |
| 430 | 1.40 | 5775 | 8.8 | 6.8 |

EXAMPLE 16

Surface sized paper samples sized with maleated rapeseed oil (MRSO) that was prepared according example 9 and Polygraphix 2500 (PLG 2500) were compared according their sizing efficiency. Polygraphix 2500 (PLG 2500) is a market established anionic surface size based on styrene acrylate copolymer. The used paper was unsized copy paper (Grammage 135 g/m$^2$).

496 g of an oxidatively degraded starch solution and 4 g 50% alum solution were well mixed. Then 0.25 w-%, 0.1 w-% and 0.05 w-% sizing agent were added (calculated on its active content)

For this test Polygraphix 2500, and maleated rapeseed oil (MRSO)—the latter containing 1% emulsifier (Ethylan TD3070)—were used.

a) The MRSO was emulsified in the above mentioned starch solution blend with an Ultra Turrax for two minutes at 10 000 rpm.

b) Polygraphix 2500 was added to the starch solution blend and mixed well

Both emulsions were applied in a lab size press (Einlehner, Augsburg, Germany)

All surface treated paper sheets were dried in a lab drum drier (Mathis Typ.-Nr. FKD-0583) at 120° C. The Velocity for the roll was 20 m/min and the roll pressure was 5 kg/cm.

In a comparison Polygraphix 2500 as market established surface size and the modified rapeseed oil were tested regarding sizing efficiency. In Table 7 can be seen that the sizing efficiency of the modified rapeseed oil is better compared to one standard surface size Polygraphix 2500.

TABLE 7

| Size in float [w-%] | Cobb [g/m$^2$] |
|---|---|
| PLG 2500 | |
| 0.05 | 188 |
| 0.10 | 171 |
| 0.25 | 39 |
| MRSO | |
| 0.05 | 113 |
| 0.10 | 100 |
| 0.25 | 25 |

EXAMPLE 17

Part of the MSOHO product of example 10, having an R value of 1.26 and containing 1% Na-DOSS, was blended with varying ratios of FAA (Sacacid FAA 1000) ranging from 0 to 100%.

The following compositions were made: 0% FAA, 10% FAA, 20% FAA, 30 FAA, 40% FAA, 50% FAA, 60% FAA, 80% FAA, and 100% FAA. 1 g of each blend was emulsified in 99 g starch solution (4% HiCat 5103A) at 70° C., 10 000 rpm, for 2 min. This emulsion was diluted 1:10 and 2.5 ml (corresponding to 1.0 kg/t) was added to approx. 190 g of the paper stock (containing 1% fibers and 0.25% GCC) at 45° C. 1.5 ml Alum (1%) and 4.6 ml Fennopol K3400 R (0.01%) were added. Subsequently the sheets were prepared, dried in a drum dryer at ~115° C. for 40 s, and stored in a conditioning room at 21° C. and 60% relative humidity for 30 min. After this treatment $Cobb_{60}$ values were measured. Besides measuring sizing efficiency the viscosity of each composition was measured on a rota-viscosimeter (Rheometer MC1, Anton Paar GmbH, Austria) at 25° C. and 500 s$^{-1}$.

Figure 6:
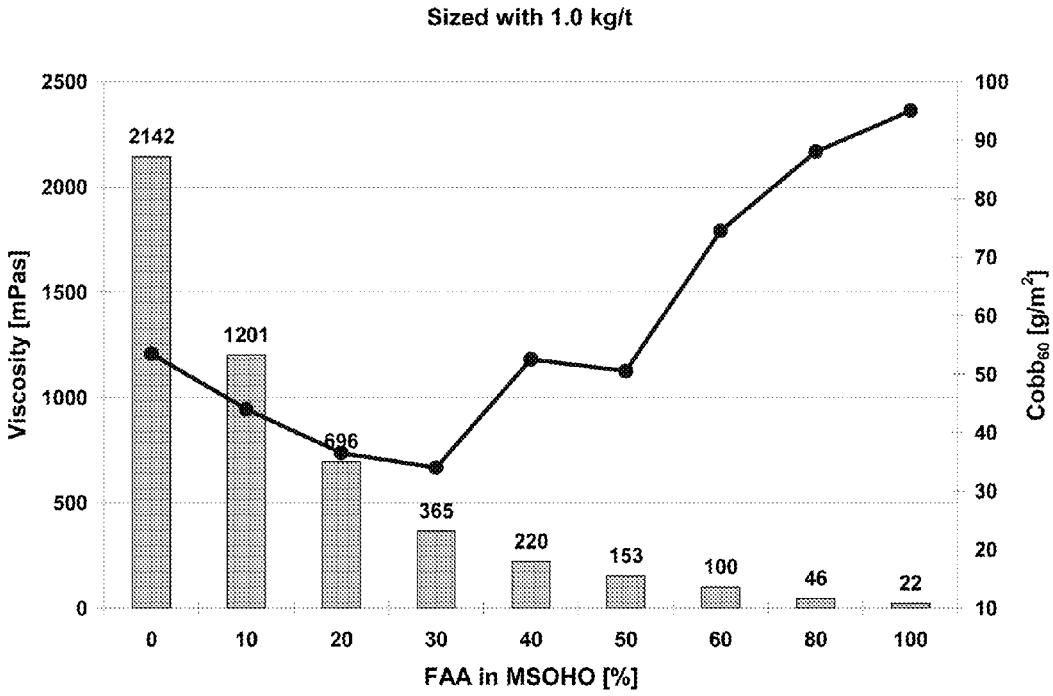
FIG. 6 shows sizing efficiency (the $Cobb_{60}$ values) and the viscosities of varying ratios of FAA added to MSOHO.

Sizing and viscosity results are combined in FIG. 6. The sizing results are mean values of two measurements except for pure FAA, were only 1 sheet was produced. For blends with up to 30% FAA the $Cobb_{60}$ values (curve) along with the viscosities (bars) decrease with the ratio FAA added to MSOHO which is a clear proof of an unexpected synergistic effect in this blend. For addition levels of 40-100% FAA $Cobb_{60}$ values increase, although viscosity is reduced further. This is explained with the weaker sizing efficiency of pure FAA in comparison to MSOHO. There is an optimum for FAA-MSOHO blends according their sizing efficiency around 10-30% FAA in MSOHO.

The invention claimed is:

1. A paper sizing emulsion comprising a maleated vegetable oil size wherein at least 50% by weight of the total fatty acids of the triglycerides are monounsaturated.

2. The paper sizing emulsion according to claim 1 wherein at least 60% by weight of the total fatty acids of the triglycerides are monounsaturated.

3. The paper sizing emulsion according to claim 1 wherein the maleated vegetable oil originates from vegetable oil comprising rapeseed oil, high oleic sunflower oil, high oleic safflower oil, olive oil or hazelnut oil or a mixture thereof.

4. The paper sizing emulsion according to claim 1 additionally comprising a second size comprising an alkenyl succinic anhydride (ASA) size or a fatty acid anhydride (FAA) size or a mixture thereof.

5. The paper sizing emulsion according to claim 4 wherein the fatty acid anhydride consists of two fatty acids, of a fatty acid and acetic acid, of a fatty acid and a rosin acid, or a mixture thereof.

6. The paper sizing emulsion according to claim 4 wherein the fatty acid of the fatty acid anhydride size is derived from tall oil, sunflower oil, rapeseed oil, soy bean oil, linseed oil or animal oil.

7. The paper sizing emulsion according to claim 4 wherein the weight ratio of the maleated vegetable oil size to the second size is from 1:9 to 9:1.

8. The paper sizing emulsion according to claim 1 additionally comprising an anionic or non-ionic emulsifier, selected from a sulfosuccinate or fatty alcohol ethoxylate.

9. The paper sizing emulsion according to claim 1 additionally comprising an aluminium salt selected from aluminium sulphate or polyaluminium chloride.

10. The paper sizing emulsion according to claim 1 additionally comprising a protective colloid selected from polymer, starch, or another polysaccharide.

11. The paper sizing emulsion according to claim 2 wherein the molar ratio of maleic acid anhydride to triglyceride in the maleated vegetable oil is at least 0.8:1.

12. The paper sizing emulsion according to claim 1 wherein the molar ratio of maleic acid anhydride to triglyceride in the maleated vegetable oil is at most 2:1.

13. The paper sizing emulsion according to claim 12 wherein the maleated vegetable oil is produced by reacting maleic acid anhydride with the vegetable oil in the presence of an antioxidant selected from vitamin E or a phenolic compound, or a mixture thereof.

14. The paper sizing emulsion according to claim 12 wherein said emulsion comprises from 0.1 weight-% to 10 weight-% of sizing agent.

15. A paper sizing agent comprising a maleated vegetable oil wherein at least 50% by weight of the total fatty acids of the triglycerides are monounsaturated, and an alkenyl succinic anhydride (ASA), a fatty acid anhydride (FAA), or a mixture thereof.

16. The paper sizing agent according to claim 15 wherein at least 60% by weight of the total fatty acids of the triglycerides are monounsaturated.

17. The paper sizing agent according to claim 15 wherein the maleated vegetable oil originates from vegetable oil comprising rapeseed oil, high oleic sunflower oil, high oleic safflower oil, olive oil or hazelnut oil or a mixture thereof.

18. The paper sizing agent according to claim 15 wherein the fatty acid anhydride consists of two fatty acids, of a fatty acid and acetic acid, of a fatty acid and a rosin acid, or a mixture thereof.

19. The paper sizing agent according to claim 15 wherein the fatty acid of the fatty acid anhydride is derived from tall oil, sunflower oil, rapeseed oil, soy bean oil, linseed oil or animal oil.

20. The paper sizing agent according to claim 15 wherein the amount of the maleated vegetable oil together with FAA is from 10% to 90% by weight.

21. The paper sizing agent according to claim 15 wherein the molar ratio of maleic acid anhydride to triglyceride in the maleated vegetable oil is at least 0.8:1.

22. The paper sizing agent according to claim 15 additionally comprising an antioxidant, an anionic or non-ionic emulsifier or a mixture thereof.

23. A process for the preparation of a paper sizing emulsion of claim 1 comprising emulsifying a maleated vegetable oil size wherein at least 50% by weight of the total fatty acids of the triglycerides are monounsaturated in an aqueous phase by means of an emulsifier, by means of vigorous mixing, or a combination thereof.

24. The process for the preparation of a paper sizing agent of claim 15 comprising mixing a maleated vegetable oil wherein at least 50% by weight of the total fatty acids of the triglycerides are monounsaturated with an alkenyl succinic anhydride (ASA), a fatty acid anhydride (FAA), or a mixture thereof.

25. The process according to claim 24 wherein the maleated vegetable oil is produced by reacting maleic acid anhydride with the vegetable oil in the presence of an antioxidant such as vitamin E or a phenolic compound or a mixture thereof.

26. A method for surface sizing or internal sizing of paper or board, comprising introducing a paper sizing emulsion as defined in claim 1 to the paper or board, or a precursor paper or board material.

27. The method according to claim 26 wherein an aluminium salt selected from aluminium sulphate or polyaluminium chloride is added separately into the sizing after the addition of the paper sizing emulsion.

28. A paper sizing emulsion comprising a maleated vegetable oil size wherein at least 50% by weight of the total fatty acids of the triglycerides are monounsaturated, and a second size comprising a fatty acid anhydride (FAA) size or a mixture of an alkenyl succinic anhydride (ASA) size and a fatty acid anhydride (FAA) size, wherein the fatty acid anhydride consists of two fatty acids, of a fatty acid and acetic acid, of a fatty acid and a rosin acid, or a mixture thereof.

29. The paper sizing emulsion according to claim 28, wherein the fatty acid of the fatty acid anhydride size is derived from tall oil, sunflower oil, rapeseed oil, soy bean oil, linseed oil or animal oil.

30. A paper sizing emulsion comprising a maleated vegetable oil size wherein at least 50% by weight of the total fatty acids of the triglycerides are monounsaturated, and a second size comprising an alkenyl succinic anhydride (ASA) size or a fatty acid anhydride (FAA) size or a mixture thereof, wherein the weight ratio of the maleated vegetable oil size to the second size is from 1:9 to 9:1.

31. A paper sizing emulsion comprising a maleated vegetable oil size wherein at least 50% by weight of the total fatty acids of the triglycerides are monounsaturated, and wherein the molar ratio of maleic acid anhydride to triglyceride in the maleated vegetable oil is at least 0.8:1.

32. A paper sizing emulsion comprising a maleated vegetable oil size wherein at least 50% by weight of the total fatty acids of the triglycerides are monounsaturated, and wherein the molar ratio of maleic acid anhydride to triglyceride in the maleated vegetable oil is at most 2:1.

33. A paper sizing agent comprising a maleated vegetable oil wherein at least 50% by weight of the total fatty acids of the triglycerides are monounsaturated, and a fatty acid anhydride (FAA) or a mixture of an alkenyl succinic anhydride (ASA) and a fatty acid anhydride (FAA), wherein the fatty acid anhydride consists of two fatty acids, of a fatty acid and acetic acid, of a fatty acid and a rosin acid, or a mixture thereof.

34. A paper sizing agent comprising a maleated vegetable oil wherein at least 50% by weight of the total fatty acids of the triglycerides are monounsaturated, and a fatty acid anhydride (FAA), wherein the amount of the maleated vegetable oil together with FAA is from 10% to 90% by weight.

35. A paper sizing agent comprising a maleated vegetable oil wherein at least 50% by weight of the total fatty acids of the triglycerides are monounsaturated, and an alkenyl succinic anhydride (ASA), a fatty acid anhydride (FAA), or a mixture thereof, wherein the molar ratio of maleic acid anhydride to triglyceride in the maleated vegetable oil is at least 0.8:1.

* * * * *